US007847670B2

(12) United States Patent
Uchiyama

(10) Patent No.: US 7,847,670 B2
(45) Date of Patent: Dec. 7, 2010

(54) COIL APPARATUS

(75) Inventor: Takahiro Uchiyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/393,140

(22) Filed: Feb. 26, 2009

(65) Prior Publication Data

US 2009/0231079 A1 Sep. 17, 2009

(30) Foreign Application Priority Data

Mar. 14, 2008 (JP) ..... 2008-066544

(51) Int. Cl.
*H01F 27/29* (2006.01)
*H01F 27/30* (2006.01)

(52) U.S. Cl. ..... 336/208; 336/192

(58) Field of Classification Search ..... None
See application file for complete search history.

(56) References Cited

U.S. PATENT DOCUMENTS 4,546,340 A * 10/1985 Kuchuris ..... 336/192
5,307,038 A * 4/1994 Ishimaru ..... 335/296
5,691,583 A * 11/1997 Suzuki et al. ..... 310/49.13
7,306,475 B2 * 12/2007 Tsuruta ..... 439/364
7,598,837 B2 * 10/2009 Gilmartin et al. ..... 336/192

FOREIGN PATENT DOCUMENTS

JP 2002-270420 9/2002

* cited by examiner

*Primary Examiner*—Anh T Mai
(74) *Attorney, Agent, or Firm*—Gerald E. Hespos; Michael J. Porco

(57) ABSTRACT

A coil apparatus (10) including a winding (11), a bobbin (12) around which the winding (11) is wound, and a terminal fitting (13) connected with the winding (11). In this construction, the terminal fitting (13) is mounted on the bobbin (12), and a connector (15) for connecting the terminal fitting (13) to an external connector is formed integrally with the bobbin (12). The coil apparatus can be produced at a low cost because the connector (15) is formed integrally with the bobbin (12) around which the winding (11) is wound.

13 Claims, 13 Drawing Sheets

COIL APPARATUS

BACKGROUND OF THE INVENTION

1. Field of the Invention

The invention relates to a coil apparatus.

2. Description of the Related Art

Japanese Patent Application Laid-Open No. 2002-270420 discloses a coil apparatus having a winding wound around a bobbin and a separately formed outer component that is mounted on the periphery of the bobbin. The winding that is wound onto the bobbin has a pull-out portion and a terminal fitting is connected with the pull-out portion and the separately formed outer component is mounted on the periphery of the bobbin. The separately formed outer component is formed integrally with an outwardly open connector and a part of the terminal fitting projects into the connector. An external connector is fit in the connector and connects to the terminal fitting disposed inside the connector of the separately formed outer component for supplying electric current to the winding.

The coil apparatus disclosed in JP 2002-270420 necessitates the outer component having the connector part to be formed separately. Therefore the production cost of the coil apparatus is high.

The invention has been completed in view of the above-described situation and it is an object of the invention to produce the coil apparatus at a low cost

SUMMARY OF THE INVENTION

The invention relates to coil apparatus that includes a bobbin and a winding that is wound around the bobbin. A terminal fitting is connected with the winding and is mounted on the bobbin. A connector is formed integrally with the bobbin for connecting the terminal fitting to an external connector. The formation of the connector integrally with the bobbin around which the winding is wound enables the coil apparatus to be produced at a lower cost than the conventional coil apparatus that mounts the separately formed outer component on the bobbin.

A protection material preferably is formed on a periphery of a connection portion where the winding and the terminal fitting are connected to each other for protecting the connecting portion.

A protection material also preferably is formed on a periphery of the winding for protecting the winding wound around the bobbin.

The bobbin preferably has an approximately annular main body. The connector part has a projection that projects radially out from the main body of the bobbin. A fit-in portion is continuous with the projection and can receive the external connector. The connection portion where the terminal fitting and the winding are connected to each other projects out from the projection. This construction allows an efficient connection of the terminal fitting and the winding to each other at a position outward from the main body in the radial direction thereof.

A guide groove preferably is formed on the projection for guiding the winding to the connection portion where the terminal fitting and the winding are connected to each other. Thus, the winding can be placed easily in position for the connection portion where the winding and the terminal fitting are connected to each other by disposing the winding along the guide groove and the auxiliary guide groove.

The terminal fitting preferably is inserted into the bobbin. This construction allows the terminal fitting to be resistant to heat and vibration.

The invention enables the coil apparatus to be produced at a low cost.

DETAILED DESCRIPTION OF THE PREFERRED EMBODIMENTS

A coil apparatus in accordance with the invention is illustrated in FIGS. 1 through 13 and is identified generally by the numeral 10. The coil apparatus 10 is part of a solenoid for use in a driving system of a vehicle.

Figure 1:
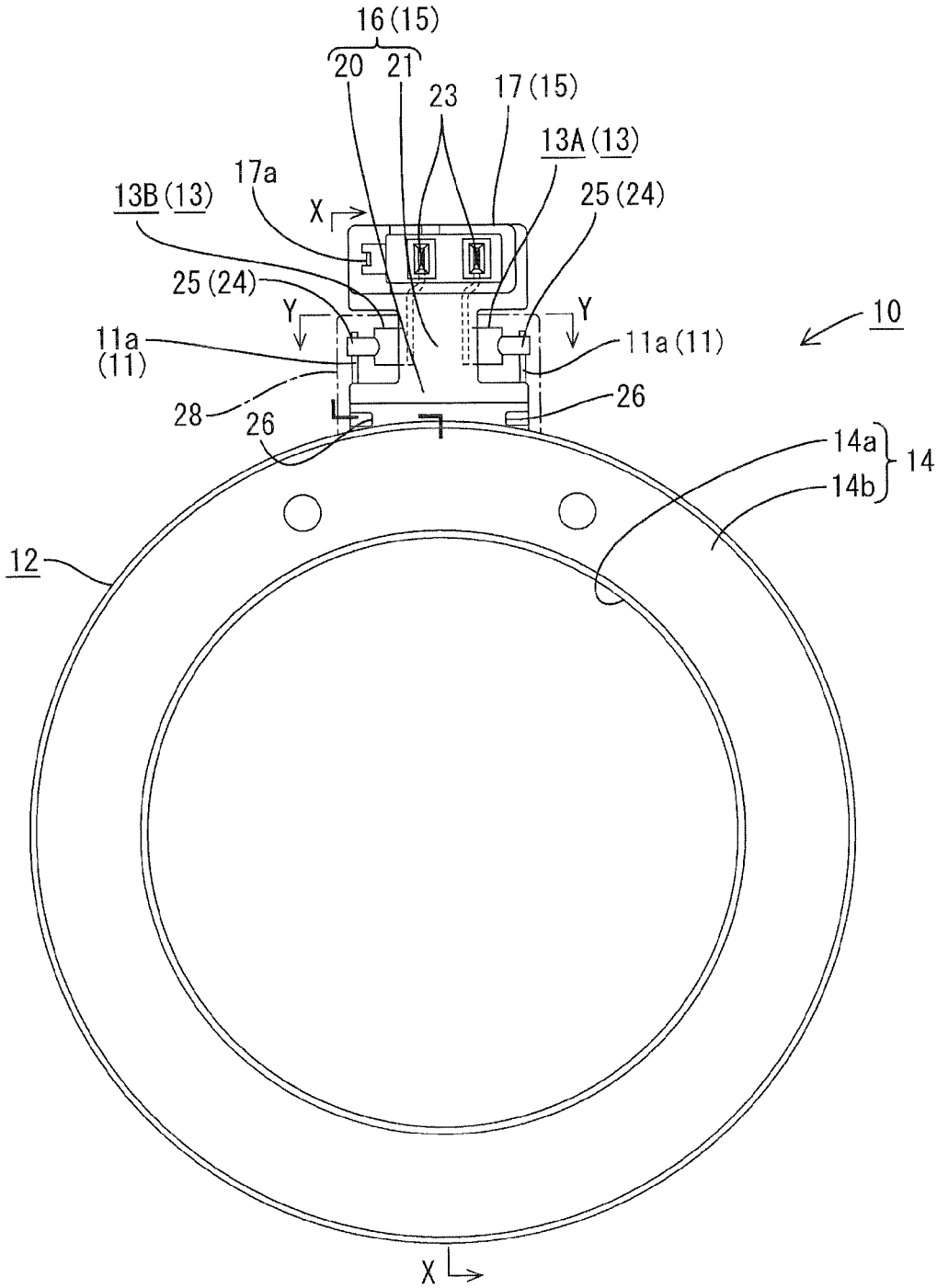
FIG. 1 is a front view of a coil apparatus in accordance with the invention.
Figure 2:
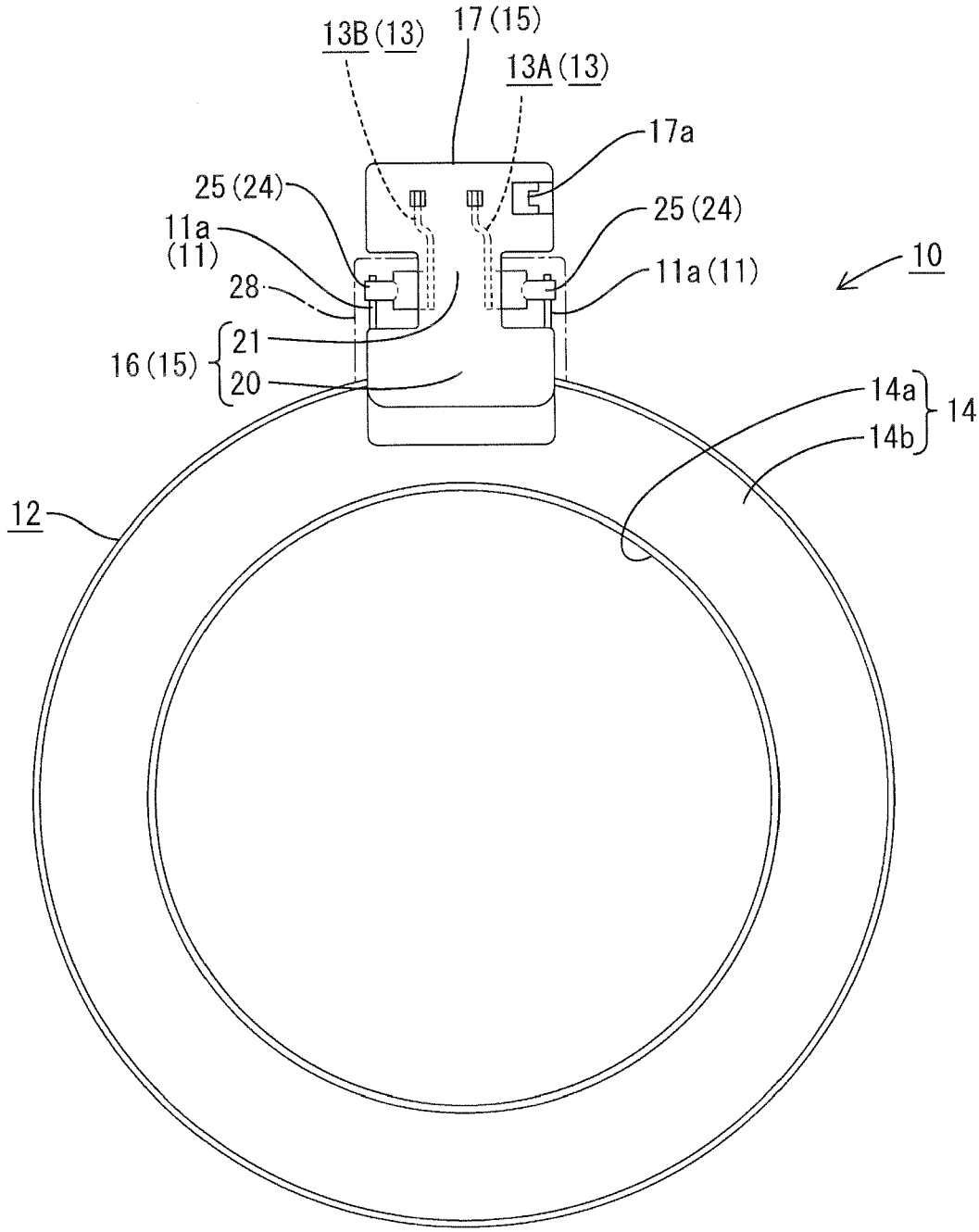
FIG. 2 is a rear view of the coil apparatus.
Figure 3:
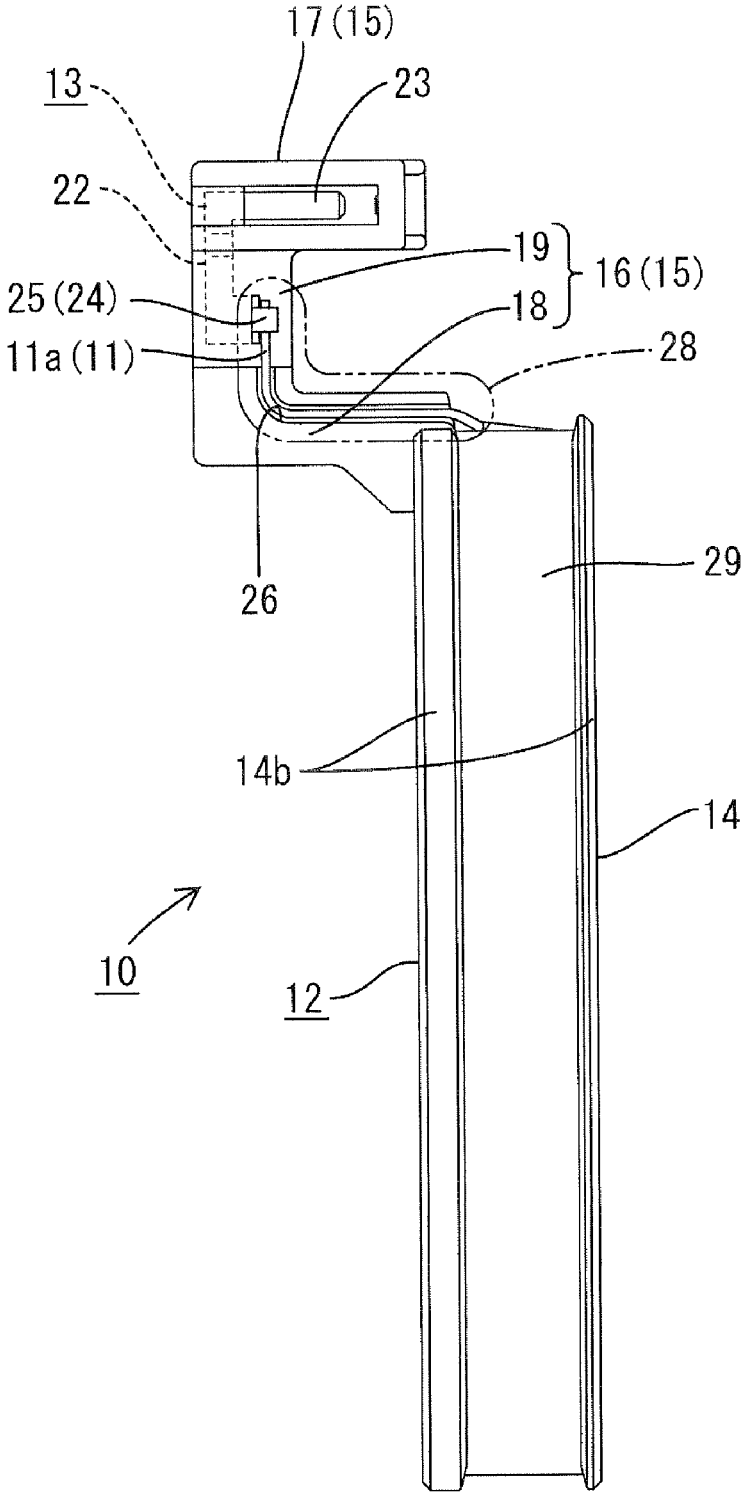
FIG. 3 is a side view of the coil apparatus.
Figure 4:
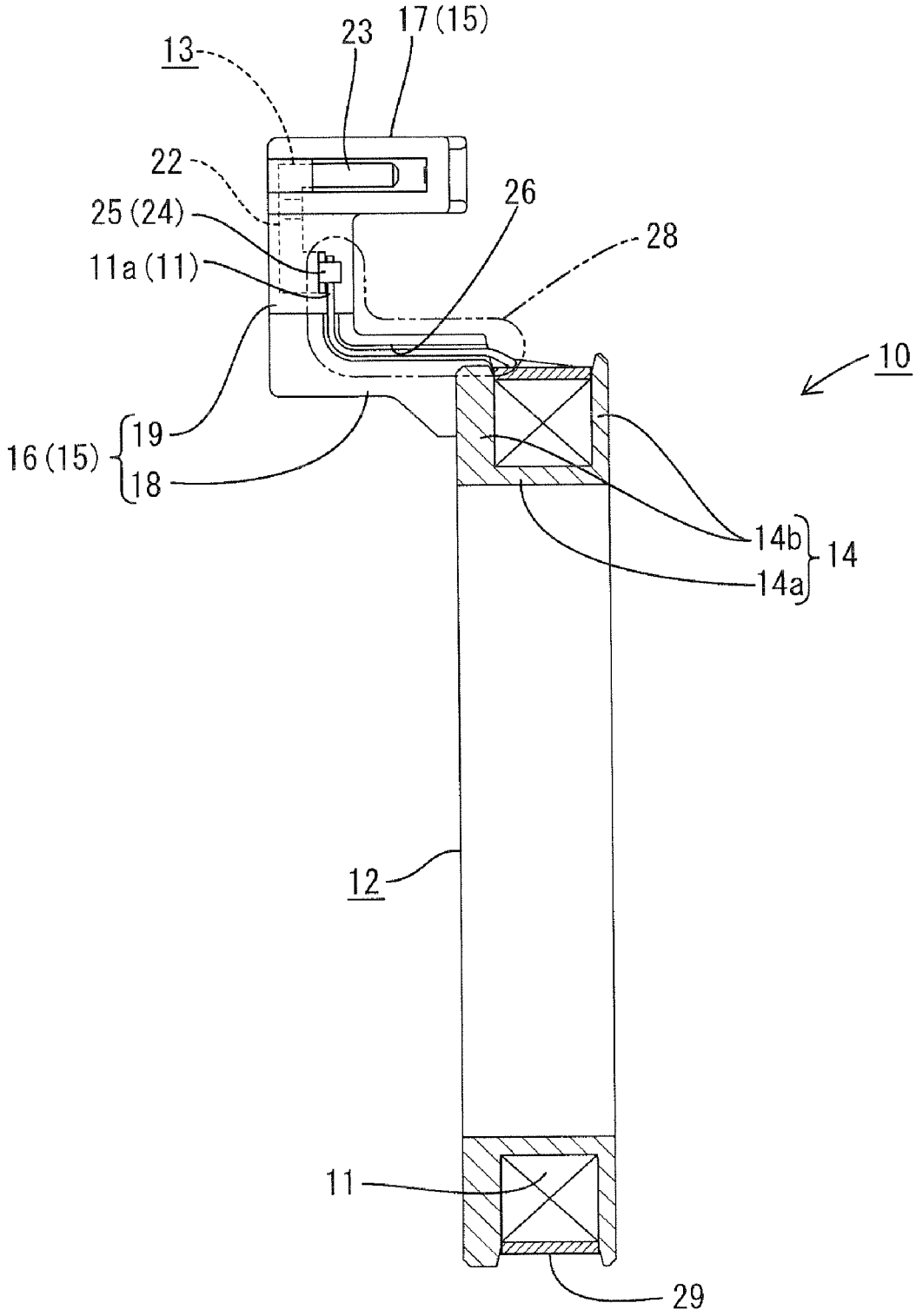
FIG. 4 is a sectional view taken along a line X-X of FIG. 1.

As shown in FIGS. 1 through 4, the coil apparatus 10 has a winding 11, a bobbin 12 around which the winding 11 is wound, and two terminal fittings 13 connected with the winding 11. The coil apparatus 10 further has a connector 15 for connecting the terminal fittings 13 to terminals of an external connector (not shown) that is part of an external circuit. In the following description, the right side shown in FIG. 4 is referred to as the front and the left side in FIG. 1 is referred to as the rear.

Figure 6:
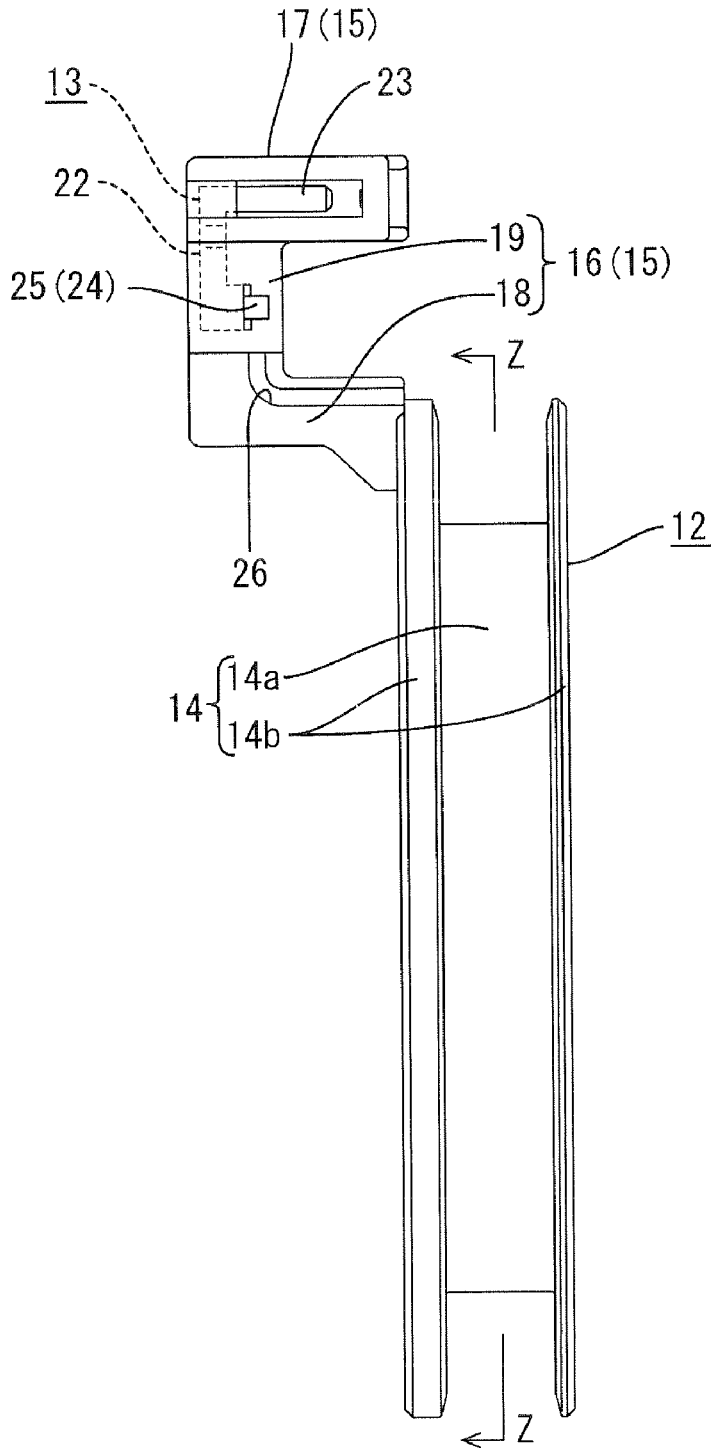
FIG. 6 is a side view of a bobbin.

The winding 11 has of a narrow wire made of a metal, such as copper, with excellent electrical conductivity. As shown in FIG. 4, the winding 11 is an annular coil with multiple turns wound around the bobbin 12. The bobbin 12 is made of a synthetic resin that exhibits an insulating property and has an annular main body 14. As shown in FIG. 6, the main body 14 has a cylindrical part 14*a* around which the winding 11 is wound and flanges 14*b* project radially out from both ends of the cylindrical part 14*a*. A space surrounded with the cylindrical part 14*a* and the flanges 14*b* opens out in the radial direction and the winding 11 is disposed in the space. As shown in FIG. 4, the winding 11 is wound around a peripheral surface of the cylindrical part 14*a* and is held thereon with the winding 11 sandwiched between the flanges 14*b*. Each terminal fitting 13 is made of an electrically conductive metal. One end of each terminal fitting 13 is connectable to the winding 11 and the other end thereof is connectable to an external terminal (not shown) mounted on the external connector.

The connector 15 on which the terminal fitting 13 is mounted is formed unitarily with the main body 14 of the bobbin 12. As shown in FIGS. 3 and 4, the connector 15 has a projection 16 and a fit-in portion 17 that is continuous with the projection 16. The projection 16 projects from an outer surface of the rear flange 14*b* of the main body 14, which is a surface facing the rear side opposite to the position where the winding 11 is disposed. The projection 16 is bent midway and is approximately L-shaped. More particularly, the projection 16 has a first leg 18 that projects axially rearward from the flange 14*b* and a second leg 19 that projects radially out away from the main body 14 from a projected end of the first leg 18. As shown in FIGS. 1 and 2, the projection 16 has two different dimensions in the circumferential direction of the main body 14. More specifically the first leg 18 and a proximal portion of the second leg 19 define a wide part 20, whereas a distal portion of the second leg 19 defines a narrow part 21.

As shown in FIG. 3, the fit-in portion 17 is continuous with the projected distal end of the second leg 19 of the projection 16 and projects forward from the second leg 19 along the axis of the main body 14 of the bobbin 12. The fit-in portion 17 is open forward and is approximately tubular so that the external connector can be fit in the fit-in portion 17 from the front along the axis of the main body 14 of the bobbin 12. A lock 17*a* is formed on a peripheral wall of the fit-in portion 17 (left wall in FIG. 1, right wall in FIG. 2) for holding the external connector in a fit-in state. The dimension of the fit-in portion 17 in the right-to-left in FIGS. 1 and 2 (circumferential direction) is equal to the width of the wide part 20 of the projection 16. Therefore two concave spaces are formed between the fit-in portion 17 and the wide part 20 and open to left and right directions shown in FIGS. 1 and 2.

First and second terminal fittings 13A and 13B are inserted into the connector 15 of the bobbin 12 in correspondence to the pull-out portions 11*a* of the winding 11. The first terminal fitting 13A is at the right side in FIG. 1 and the second terminal fitting 13B at the left-hand side in FIG. 1. The first and second terminal fittings 13A and 13B are referred to collectively by the numeral 13.

Figure 8:
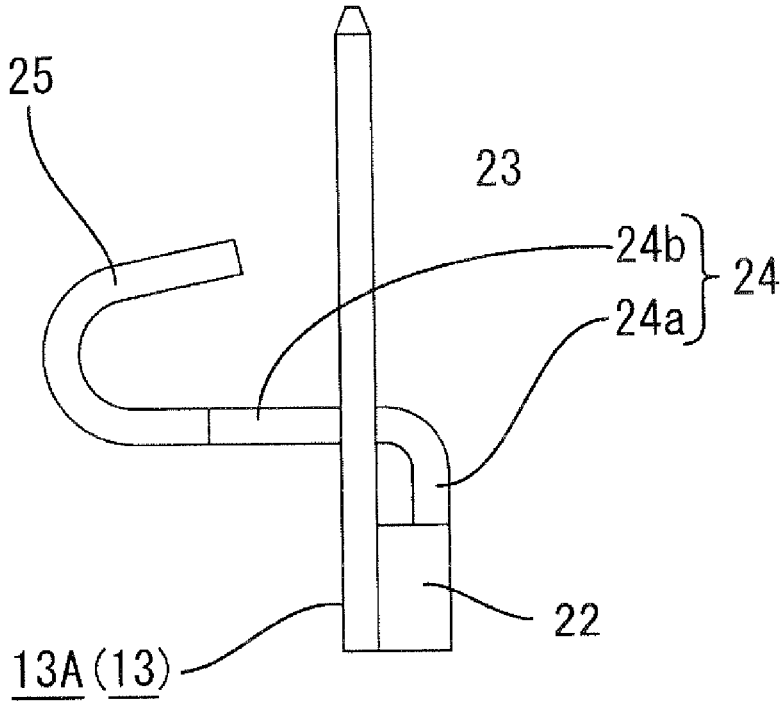
FIG. 8 is a plan view of a first terminal fitting.
Figure 9:
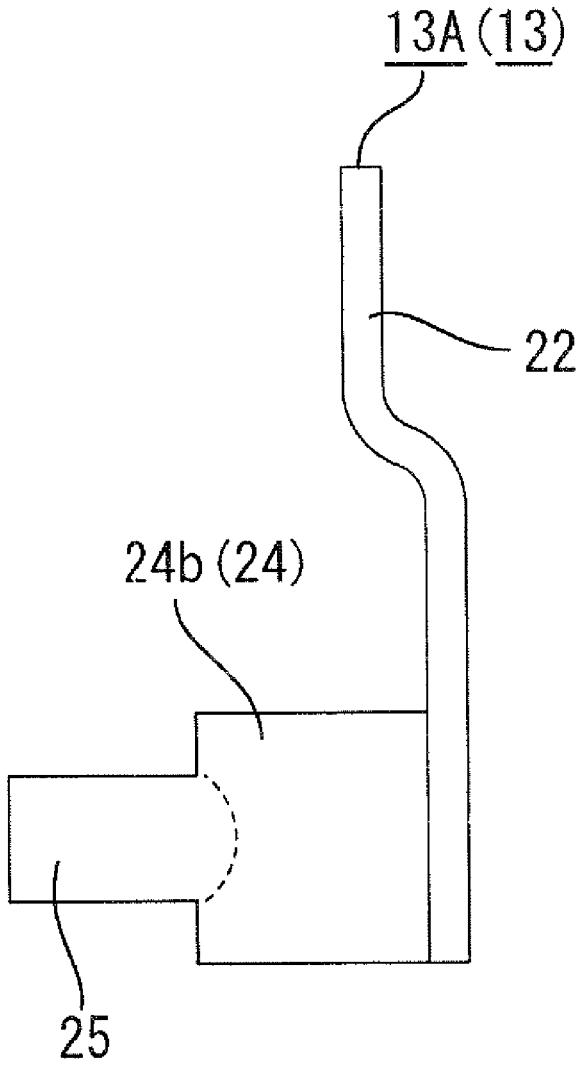
FIG. 9 is a rear view of the first terminal fitting.
Figure 10:
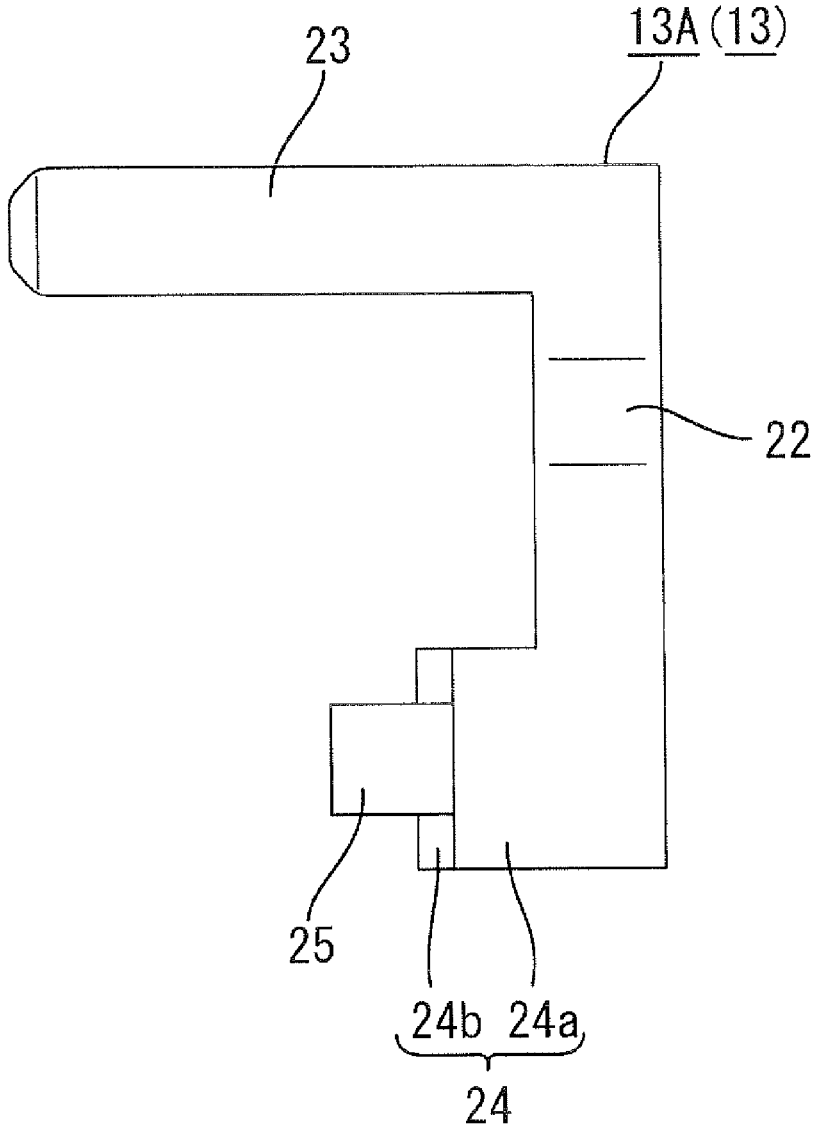
FIG. 10 is a side view of the first terminal fitting.
Figure 11:
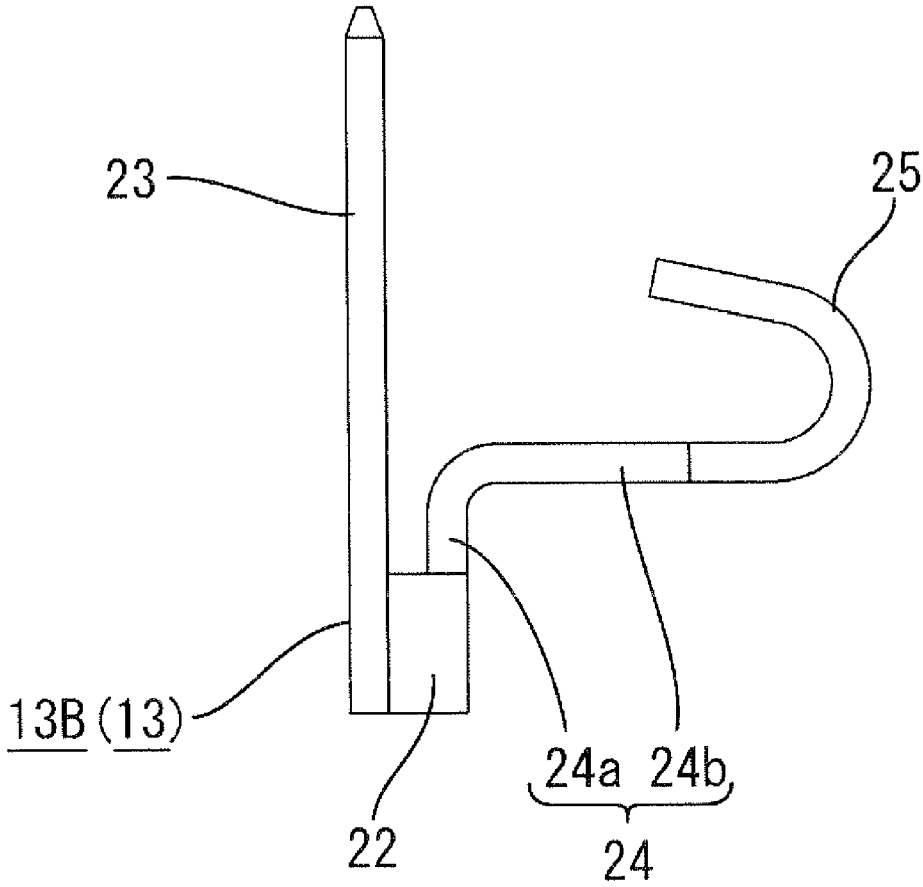
FIG. 11 is a plan view of a second terminal fitting.
Figure 12:
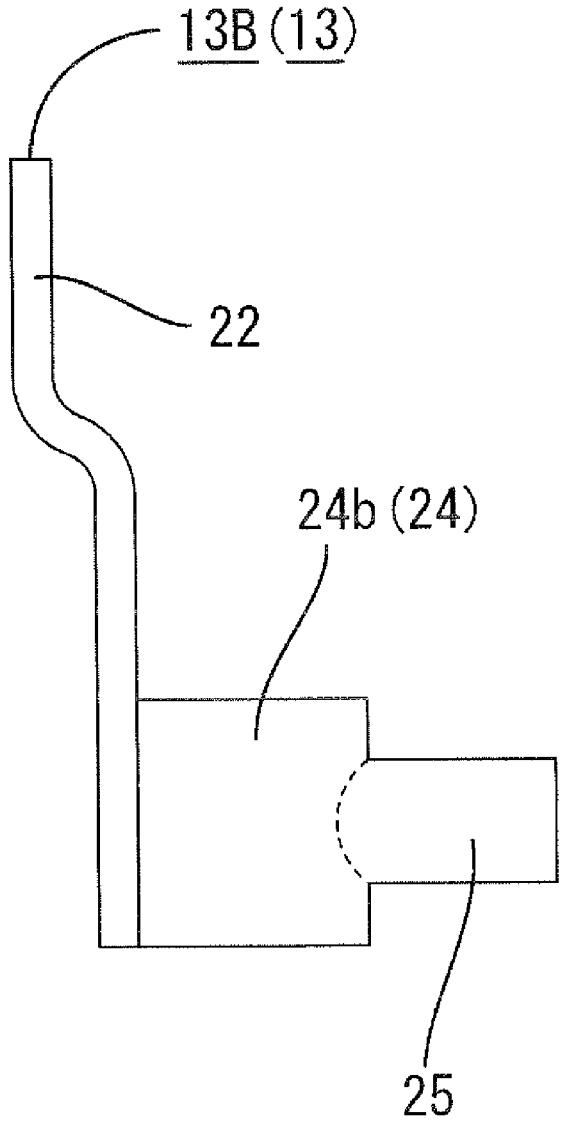
FIG. 12 is a rear view of the second terminal fitting.
Figure 13:
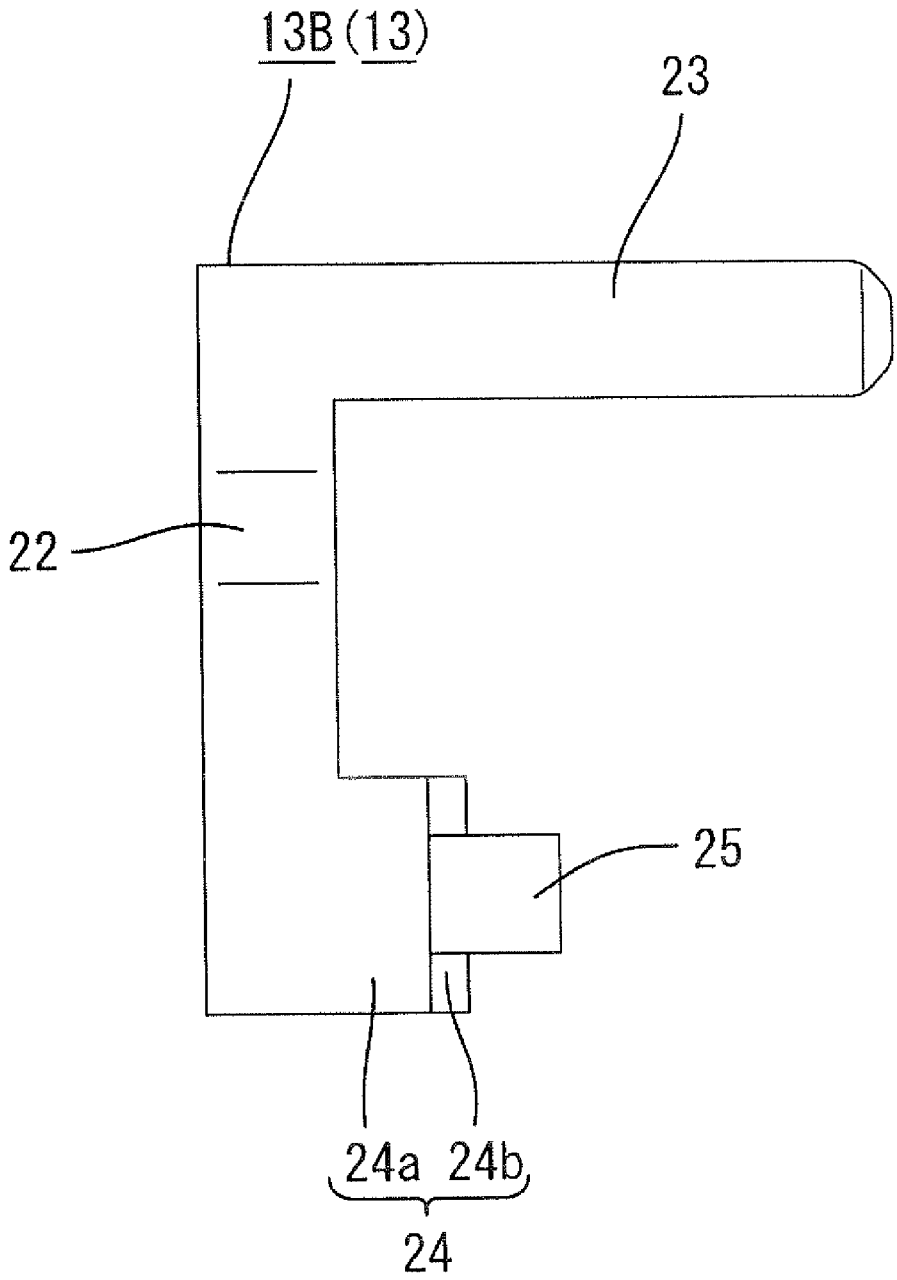
FIG. 13 is a side view of the second terminal fitting.

As shown in FIGS. 8 through 13, the terminal fittings 13 have a proximal part 22 embedded inside the connector 15; a connector-side connection part 23 disposed at one side of the proximal part 22 for connection to the terminal of the external connector; and a winding-side connection part 24 disposed at the other side of the proximal part 22 for connection to the winding 11. As shown in FIGS. 1 and 2, the proximal part 22 is embedded inside the second leg 19 of the projection 16 of the connector 15 and extends in the projected direction of the second leg 19, which is the radial direction of the main body 14. As shown in FIGS. 9 and 12, the proximal part 22 is approximately crank-shaped in a front view with two bent portions that are curved.

As shown in FIGS. 1 and 3, the connector-side connection part 23 projects forward from an end of the proximal part 22 at the side of the fit-in portion 17, which is at the outer side in the radial direction of the main body 14. The connector-side connection part 23 extends substantially straight and parallel to the axis of the main body 14 of the bobbin 12 into a space inside the fit-in portion 17. The connector-side connection part 23 is surrounded with the peripheral wall of the fit-in portion 17 and can be connected electrically to the terminal of the external connector to be fit in the fit-in portion 17. As shown in FIGS. 8 and 11, the connector-side connection part 23 is tab-shaped with a tapered distal end.

Figure 5:
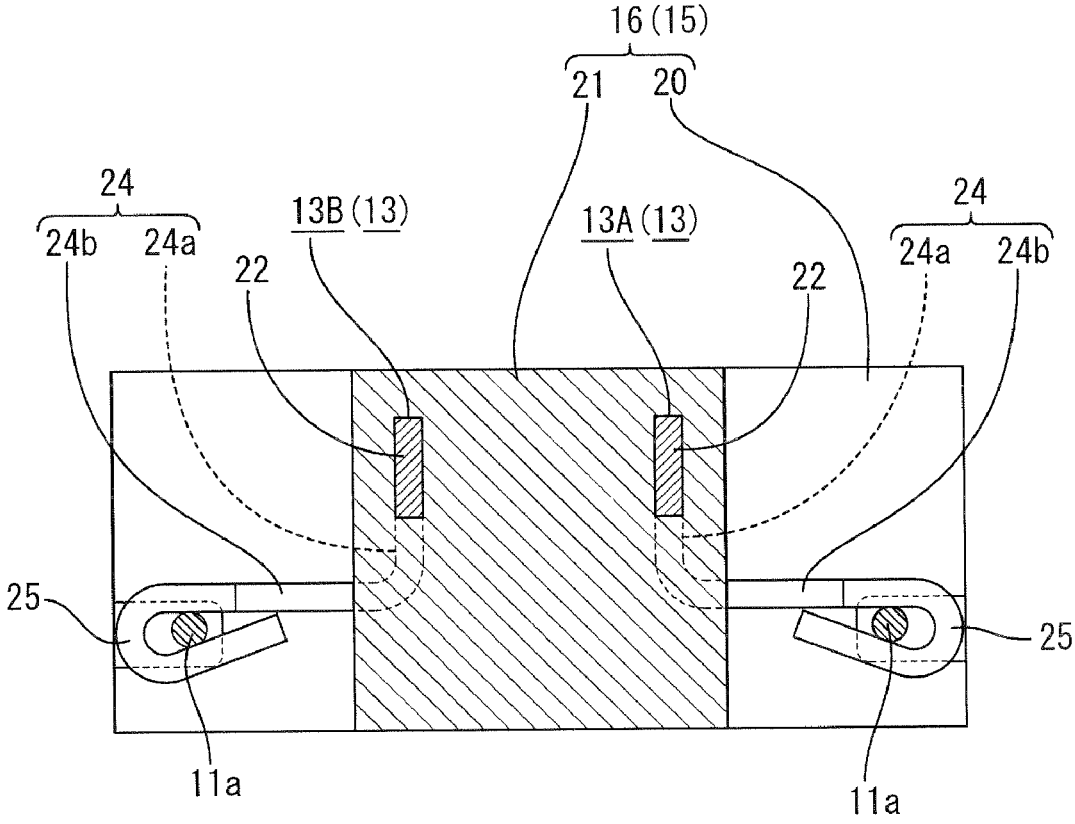
FIG. 5 is a sectional view taken along a line Y-Y of FIG. 1.

The winding-side connection part 24 projects from an end of the proximal part 22 at the side of the main body 14 of the bobbin 12 to the outside of the second leg 19, as shown in FIGS. 1 and 2,. More specifically, the winding-side connection part 24 has a proximal portion 24*a* that projects forward in the axial direction of the main body 14 from the end of the proximal part 22 and a counterpart portion 24*b* bent at an end of the proximal portion 24*a* and projected sideways along the right-to-left direction or circumferential direction. The proximal portion 24*a* of the winding-side connection part 24 and a projected proximal side of the counterpart portion 24*b* are embedded inside the second leg 19, as shown in FIG. 5. A projected distal side of the counterpart portion 24*b* is exposed at the outside of the second leg 19. As shown in FIGS. 8 and 11, a distal side of the counterpart portion 24*b* is folded back in a U-shape to define a folded-back portion 25. The folded-back portion 25 is capable of retaining the distal end of the pull-out portion 11*a* in the space thereof and defines a portion where the terminal fitting 13 is connected to the winding 11. As shown in FIGS. 9 and 12, the winding-side connection part 24 is stepped to have two different width dimensions. More specifically the proximal portion 24*a* and a part of the counterpart portion 24*b* except the folded-back portion 25 (a portion of the counterpart portion 24*b* nearer to the proximal portion 24*a* than to the folded-back portion 25) are comparatively wide, whereas the folded-back portion 25 is comparatively narrow.

The proximal parts 22 and the connector-side connection parts 23 of the first and second terminal fittings 13A and 13B have almost the same configuration, but the winding-side connection parts 24 have different configurations. More particularly, as shown in FIGS. 1 and 2, the projected direction of the counterpart portion 24*b* of the winding-side connection part 24 of the first terminal fitting 13A and the projected direction of the counterpart portion 24*b* of the winding-side connection part 24 of the second terminal fitting 13B are opposite to each other with the counterpart portions 24*b* almost symmetrical to each other with respect to a central position between the first and second terminal fittings 13A and 13B. Specifically, the counterpart portion 24*b* of the winding-side connection part 24 of the first terminal fitting 13A projects to the right side in FIG. 1, and to the side opposite to the second terminal fitting 13B. On the other hand, the counterpart portion 24*b* of the winding-side connection part 24 of the second terminal fitting 13B projects to the left side in FIG. 1, and to the side opposite to the first terminal fitting 13A. Therefore, the inner peripheral surfaces of the folded-back portions 25 (contact surface thereof with the winding 11) of both counterpart portions 24*b* face each other before the winding 11 is connected to the terminal fitting 13 (see FIGS. 6 and 7). As shown in FIG. 8, the counterpart portions 24*b* of the first and second terminal fittings 13A and 13B differ in that the counterpart portion 24*b* of the first terminal fitting 13A crosses the connector-side connection part 23, whereas the counterpart portion 24*b* of the second terminal fitting 13B does not cross the connector-side connection part 23.

As shown in FIGS. 1 and 2, the winding-side connection parts 24 of the first and second terminal fittings 13 project outward almost symmetrically from both side surfaces of the narrow portion 21 of the second projection 19. The projected distal-ends of the counterpart portion 24*b* of the winding-side connection parts 24 are disposed in the concave spaces sandwiched between the wide portion 20 and the fit-in portion 17. The projected distal-end surfaces of the winding-side connection parts 24 are almost flush with outer side surfaces of the wide portion 20 and those of the fit-in portion 17 in the right-to-left direction, as shown in FIGS. 1 and 2.

Two guide grooves 26 are formed on outer side surfaces of the respective wide portion 20 for guiding pull-out portions 11*a* of the winding 11 to the winding-side connection part 24. As shown in FIG. 6, the guide groove 26 is approximately L-shaped in a side view. The guide groove 26 has a portion extended along the axis of the main body 14 and a portion extended in the radial direction thereof. The portion of the guide groove 26 extended along the axis of the main body 14 is positioned radially outward from a peripheral end of the rear flange 14*b* of the main body 14, which is the flange 14*b* that is continuous with the connector 15. Thus, it is possible to easily enter the pull-out portion 11*a* pulled out of the outermost peripheral end of the winding 11 wound around the main body 14 into the guide groove 26. The portion of the guide groove 26 extended in the radial direction of the main body 14 is formed at a position almost matching the position of the folded-back portion 25 of the winding-side connection part 24 in the axial direction of the main body 14 of the bobbin 12. Therefore the pull-out portion 11*a* of the winding 11 can be matched easily with the folded-back portion 25.

Figure 7:
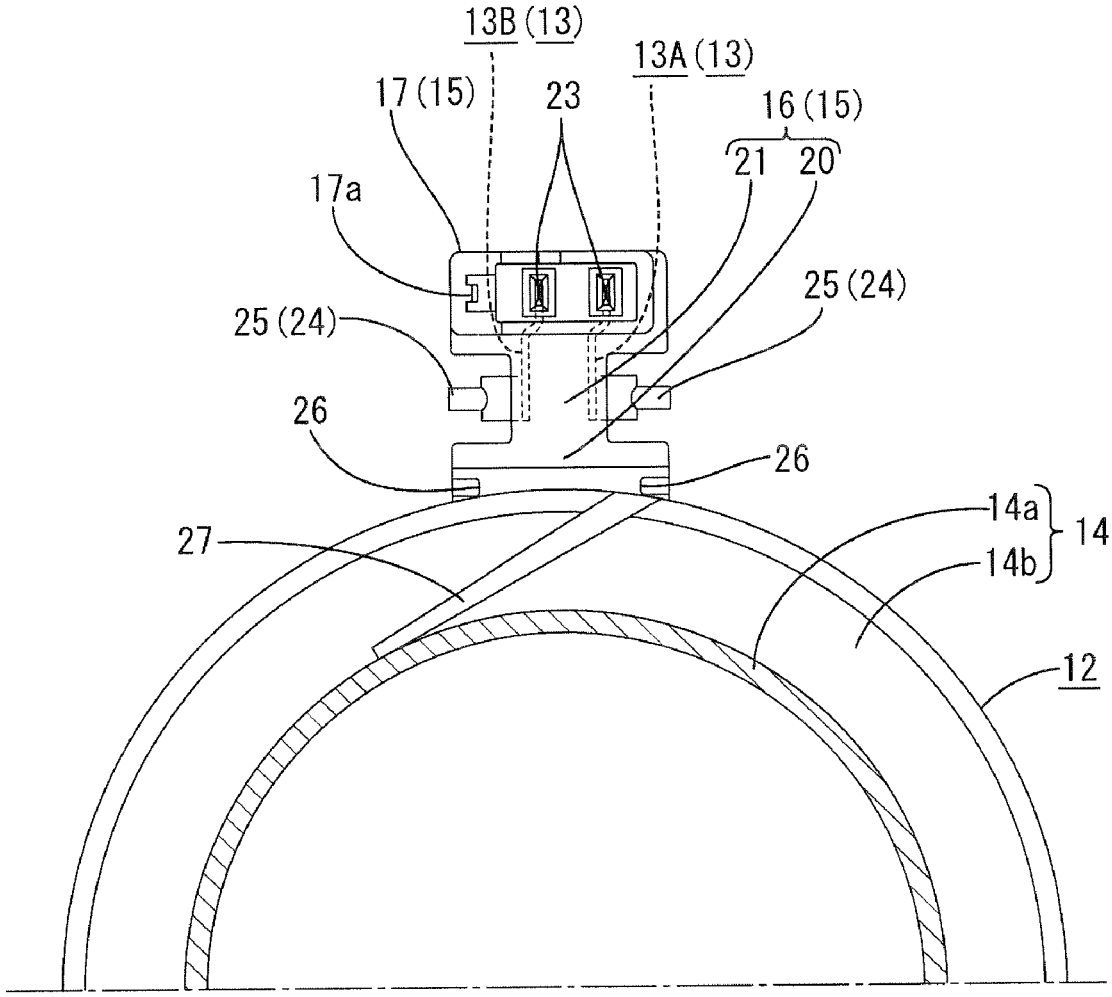
FIG. 7 is a sectional view taken along a line Z-Z of FIG. 6.

As shown in FIG. 7, an auxiliary guide groove 27 is formed on the inner surface of the rear flange 14*b* confronting the winding 11 and continuous with the connector 15. The auxiliary guide groove 27 extends almost linearly from an inner peripheral end of the flange 14*b* to an outer peripheral end thereof. The outer peripheral end of the auxiliary guide groove 27 almost matches the guide groove 26 in the circumferential direction of the main body 14 of the bobbin 12. Thus, the winding 11 can be pulled easily out from the main body 14 of the bobbin 12 and enter the winding 11 into the guide groove 26.

The connector part 15 is formed integrally with the bobbin 12. Therefore, the portion where the terminal fitting 13 and the winding 11 are connected with each other and the winding 11 wound around the main body 14 of the bobbin 12 are exposed to the outside. The exposed portions are covered with a protection material to protect the exposed portions.

More specifically, a first protection material 28 covers the periphery of the winding-side connection part 24 of the terminal fitting 13 that projects to the outside of the connector part 15 and the periphery of the pull-out portion 11*a* of the winding 11 pulled outward from the main body 14, as shown with the one-dot chain line in FIGS. 1 through 4. The first protection material 28 is made of a thermoplastic synthetic resin (for example, silicone resin). The first protection material 28 is applied to the peripheries of the winding-side connection part 24 and the pull-out portion 11*a* in a fused state, after the winding-side connection part 24 and the pull-out portion 11*a* are connected to each other. The solidified first protection material 28 covers almost the entire periphery of the winding-side connection part 24 and the pull-out portion 11*a* for securely sealing the portion where the winding-side connection part 24 and the pull-out portion 11*a* are connected to each other.

A second protection material 29 covers the periphery of the winding 11 wound around the main body 14, as shown in FIG. 4. The second protection material 29 is made of a synthetic resin and is composed of a tape having an adhesive layer on its inner surface. The second protection material 29 is wound in a plurality of layers around the winding 11, which in turn has been wound around the main body 14 of the bobbin 12. Thus, virtually the entire periphery of the winding 11 is covered with the second protection material 29 for securely sealing the winding 11.

The terminal fitting 13 is produced separately from the bobbin 12 and is inserted into a die when the unitary matrix of resin is molded to form the bobbin 12. Thus, as shown in FIGS. 6 and 7, the produced bobbin 12 is formed unitarily with the connector 15 in which the terminal fitting 13 is embedded.

The winding 11 is wound around the main body 14 of the bobbin 12 during assembly of the coil apparatus 10. The pull-out portions 11*a* at both ends of the winding 11 are pulled out from the main body 14 to the connector part 15 when the winding operation finishes. The peripheral end of the auxiliary guide groove 27 formed on the inner surface of the rear flange 14*b* continuous with the connector 15 matches the guide groove 26 formed on the side surface of the connector 15. Therefore, the pull-out portion 11*a* of the winding 11 is entered into the auxiliary guide groove 27 and guided easily to the guide groove 26. Further, the entry of the pull-out portion 11*a* of the winding 11 into the guide groove 26 enables the front end of the pull-out portion 11*a* to be matched easily with the folded-back portion 25 of the winding-side connection part 24 of the terminal fitting 13. The front end of the pull-out portion 11*a* of the winding 11 is disposed inside the folded-back portion 25, and then the folded-back portion 25 is fused thermally to the pull-out portion 11*a*. More specifically, the folded-back portion 25 is pressurized from the outside and heated to deform the folded-back portion 25 so that the pull-out portion 11*a* of the winding 11 is fixed to the folded-back portion 25 with the pull-out portion 11*a* retained in the space of the folded-back portion 25. Thus, as shown in FIG. 5, the first and second terminal fittings 13A and 13B and the pull-out portions 11*a* of the winding 11 are electrically connected with each other.

The first and second protection materials 28 and 29 then are formed on the coil apparatus 10. More particularly, the melted first protection material 28 is applied to the periphery of the terminal fitting 13, the pull-out portion 11*a* of the winding 11 exposed outside the connector 15, and the winding-side connection part 24. As a result, the first protection material 28 is formed entirely on the periphery of the pull-out portion 11*a* and the winding-side connection part 24, as shown in FIGS. 1 through 4, when the first protection material solidifies. Thus, the pull-out portion 11*a* and the winding-side connection part 24 are sealed. The tape-shaped second protection material 29 is wound in a plurality of layers around the winding 11, which already has been wound around the main body 14, and covers the entire region of the winding 11, as shown in FIG. 4. Therefore, the winding 11 is sealed.

The external connector is fit in the connector 15 to electrically connect the coil apparatus 10 produced in the above-described method to the external circuit. The connector-side connection part 23 of the terminal fitting 13 contacts the external terminal when the external connector is fit in the connector 15. Thus, the winding 11 is connected electrically to the external circuit through the terminal fitting 13. Therefore it is possible to supply electric current to the winding 11, and the locking portion 17*a* of the connector 15 stably holds the external connector in the fit-in state.

As described above, the coil apparatus 10 has the winding 11, the bobbin 12 around which the winding 11 is wound, and the terminal fitting 13. The terminal fitting 13 is mounted on the bobbin 12 and connected with the winding 11. The connector 15 for connecting the terminal fitting 13 to the external connector is formed unitarily with the bobbin 12 around which the winding 11 is wound. Thus, the coil apparatus of the invention can be produced at a lower cost than the conventional coil apparatus, because, unlike the coil apparatus of the invention, the connector part of the conventional coil apparatus is constructed by mounting the reformed outer component part on the bobbin.

The first protection material 28 is formed on the periphery of the portion where the terminal fitting 13 and the winding 11 are connected with each other and protects the portion where the winding 11 and the terminal fitting 13 are connected.

The second protection material 29 is formed on the periphery of the winding 11 and protects the winding 11 wound around the bobbin 12.

The bobbin 12 has the annular main body 14. The connector 15 has the projection 16 that projects radially out from the main body 14 and the fit-in portion 17 that is continuous with the projection 16 for receiving the external connector. The winding-side connection part 24, which is the portion where the terminal fitting 13 and the winding 11 are connected to each other, projects out from the projection 16. Thus, the terminal fitting 13 and the winding 11 are connected to each other at a position outward from the main body 14 in the radial direction thereof, and it is possible to connect the winding 11 to the terminal fitting 13 with a high efficiency.

The projection 16 has the guide groove 26 and the auxiliary guide groove 27 for guiding the winding 11 to the winding-side connection part 24, which is the portion where the terminal fitting 13 and the winding 11 are connected to each other. Thus, the winding 11 easily can be placed in position for the winding-side connection part 24 by disposing the winding 11 along the guide groove 26 and the auxiliary guide groove 27. Therefore this construction allows a high efficiency to be achieved.

The terminal fitting 13 is inserted into the bobbin 12. This construction allows the terminal fitting 13 to be excellent in its resistance to heat and vibration.

The invention is not limited to the embodiment described above with reference to the drawings. For example, the following embodiments are included in the technical scope of the present invention.

The connector is continuous with the rear flange of the main body in the above-described embodiment. However, the connector can be continuous with the front flange in accordance with the invention.

The above-described connector has a forwardly open fit-in portion. However, the fit-in portion can open rearwardly or radially outwardly, and the configuration of the terminal fitting can be altered accordingly.

The connector need not have an L-shaped projection. For example, the invention includes a projection that is straight. In this case, the projection may not have the first or second projections. It is possible to alter the configuration of the terminal fitting according to the alteration of the projection.

A connector with the projection and the fit-in portion has been described. However, the invention includes a connector that does not have the projection and whose fit-in portion is directly continuous with the main body of the bobbin.

A coil apparatus with a tubular fit-in portion and a tab-shaped connection part on the terminal fitting has been described above. That is, the coil apparatus having the male connector has been described. However, the invention includes a coil apparatus in which the fit-in portion is approximately block-shaped and the connector-side connection part accommodated in the fit-in portion has an elastic contact piece accommodated inside a box-shaped portion. That is, the invention includes a coil apparatus having a female connector.

The above-described winding-side connection part of the terminal fitting projects from the projection of the connector in the circumferential direction of the main body. However, the winding-side connection part may project from the projection of the connector in the axial direction of the main body of the bobbin.

The winding-side connection part and the winding are connected to each other by thermal welding in the above-described embodiment. However, ultrasonic welding, high-frequency welding, and the like may be used. Additionally, the winding-side connection part and the winding may be connected by caulking or crimping or other connection techniques.

The first protection material need not be the silicone resin and may be a tape that is would a plurality of times where the winding-side connection part and the pull-out portion are connected.

The second protection material need not be the tape, and may be a resin material, such as silicone resin, applied to the periphery of the winding.

In the above-described embodiment, the terminal fitting is inserted into the bobbin. However, the terminal fitting may be press fit into the resin bobbin.

The guide groove and the auxiliary guide groove may be omitted from the bobbin.

What is claimed is:

1. A coil apparatus comprising:

a bobbin;

a connector with projecting unitarily out from said bobbin and configured for connection to an external connector;

a winding wound around said bobbin and having pull-out portions projecting out from the bobbin and into the connector;

at least one terminal fitting disposed in the connector and having winding side connection parts connected with said pull-out portions of the winding; and a protection material fused to peripheries of the winding side connection part and the pull-out portions of the winding for protecting a connection between the winding side connection part and the pull-out portion.

2. The coil apparatus of claim 1, wherein the at least one terminal fitting comprises two terminal fittings.

3. The coil apparatus of claim 1, wherein the protection material is a synthetic thermoplastic resin.

4. The coil apparatus of claim 3, wherein the protection material is a silicone resin.

5. The coil apparatus of claim 1, wherein the protection material formed on a periphery of the connection portion where said winding and said terminal fitting are connected is a first protection material, the coil apparatus further having a second protection material formed on a periphery of said winding for protecting said winding.

6. The coil apparatus of claim 5, wherein the second protection material is a tape.

7. The coil apparatus of claim 1, wherein said bobbin has an approximately annular main body, said connector has a projection projecting out from said main body of said bobbin in a radial direction thereof, and a fit-in portion unitary with said projection for connection with the external connector, said terminal fitting and said winding being connected to each other at a connection portion that projects out from said projection.

8. The coil apparatus of claim 7, wherein a guide groove is formed on said projection for guiding said winding to said connection portion where said terminal fitting and said winding are connected to each other.

9. The coil apparatus of claim 1, wherein said terminal fitting is inserted molded into said bobbin.

10. The coil apparatus of claim 1, wherein said bobbin has an annular main body and first and second flanges unitary with the main body and projecting radially out from the main body, the connector including a projection unitary with the first flange and a fit-in portion unitary with the projection, said terminal fitting having a mating portion disposed in the fit-in portion and a winding connecting portion substantially adjacent a part of the projection, the winding being connected to the winding connecting portion of the terminal fitting.

11. The coil apparatus of claim 10, wherein the projection includes a guide groove extending substantially from the first flange to a position adjacent the winding connecting portion of the terminal fitting for guiding the winding to the winding connecting portion.

12. The coil apparatus of claim 11, further comprising an auxiliary guide groove formed in a surface of the first flange facing the second flange, one end of the auxiliary guide groove being substantially adjacent the guide groove for guiding the winding from the bobbin to the guide groove.

13. The coil apparatus of claim 10 wherein the bobbin and the connector are formed from a synthetic resin and a part of the terminal fitting is surrounded by a unitary matrix of the synthetic resin.

* * * * *